US011671769B2

(12) United States Patent
Lunner et al.

(10) Patent No.: US 11,671,769 B2
(45) Date of Patent: Jun. 6, 2023

(54) PERSONALIZATION OF ALGORITHM PARAMETERS OF A HEARING DEVICE

(71) Applicant: Oticon A/S, Smørum (DK)

(72) Inventors: Thomas Lunner, Redmond, WA (US); Gary Jones, Smørum (DK); Lars Bramsløw, Smørum (DK); Michael Syskind Pedersen, Smørum (DK); Pauli Minnaar, Frederiksberg (DK); Jesper Jensen, Smørum (DK); Michael Kai Petersen, Hørsholm (DK); Peter Sommer, Smørum (DK); Hongyan Sun, Smørum (DK); Jacob Schack Larsen, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 16/919,735

(22) Filed: Jul. 2, 2020

(65) Prior Publication Data

US 2022/0007116 A1 Jan. 6, 2022

(51) Int. Cl.
*H04R 25/00* (2006.01)

(52) U.S. Cl.
CPC ..... *H04R 25/505* (2013.01); *H04R 25/30* (2013.01); *H04R 2225/43* (2013.01); *H04R 2225/49* (2013.01)

(58) Field of Classification Search
CPC .... H04R 29/00; H04R 29/001; H04R 29/004; H04R 27/00; H04R 2225/43; H04R 2225/49; H04R 25/70; H04R 25/30; H04R 25/505; H04R 25/305; H04R 25/502; H04S 7/301; A61B 5/121; A61B 5/12; A61B 5/0002
USPC ..... 381/58, 60
See application file for complete search history.

(56) References Cited

U.S. PATENT DOCUMENTS

| | | | | |
|---|---|---|---|---|
| 2008/0112583 | A1 | 5/2008 | Kornagel | |
| 2010/0196861 | A1 * | 8/2010 | Lunner | H04R 25/558 434/112 |
| 2017/0230765 | A1 * | 8/2017 | Jensen | H04R 25/554 |
| 2017/0295439 | A1 * | 10/2017 | Xu | A61N 1/36036 |

(Continued)

FOREIGN PATENT DOCUMENTS

| | | | | |
|---|---|---|---|---|
| WO | WO 2019/076432 | A1 | 4/2019 | |
| WO | WO 2019/105520 | A1 | 6/2019 | |
| WO | WO-2021030584 | A1 * | 2/2021 | H04R 25/552 |

*Primary Examiner* — Ahmad F. Matar
*Assistant Examiner* — Sabrina Diaz
(74) *Attorney, Agent, or Firm* — Birch, Stewart, Kolasch & Birch, LLP

(57) ABSTRACT

A method of personalizing one or more parameters of a processing algorithm for use in a hearing aid of a specific user comprises Performing a predictive test for estimating a hearing ability of the user when listening to signals having different characteristics;

Analyzing results of said predictive test for said user and providing a hearing ability measure for said user;

Selecting a specific processing algorithm of said hearing aid,

Selecting a cost-benefit function related to said user's hearing ability in dependence of said different characteristics for said algorithm; and Determining, for said user, one or more personalized parameters of said processing algorithm in dependence of said hearing ability measure and said cost-benefit function.

27 Claims, 9 Drawing Sheets

(56) References Cited

U.S. PATENT DOCUMENTS

| | | | | |
|---|---|---|---|---|
| 2019/0110135 | A1* | 4/2019 | Jensen | H04R 25/505 |
| 2019/0320946 | A1* | 10/2019 | Bromwich | H04R 3/04 |
| 2019/0356989 | A1* | 11/2019 | Li | A61B 1/227 |
| 2020/0322742 | A1* | 10/2020 | Boretzki | H04R 25/70 |

* cited by examiner

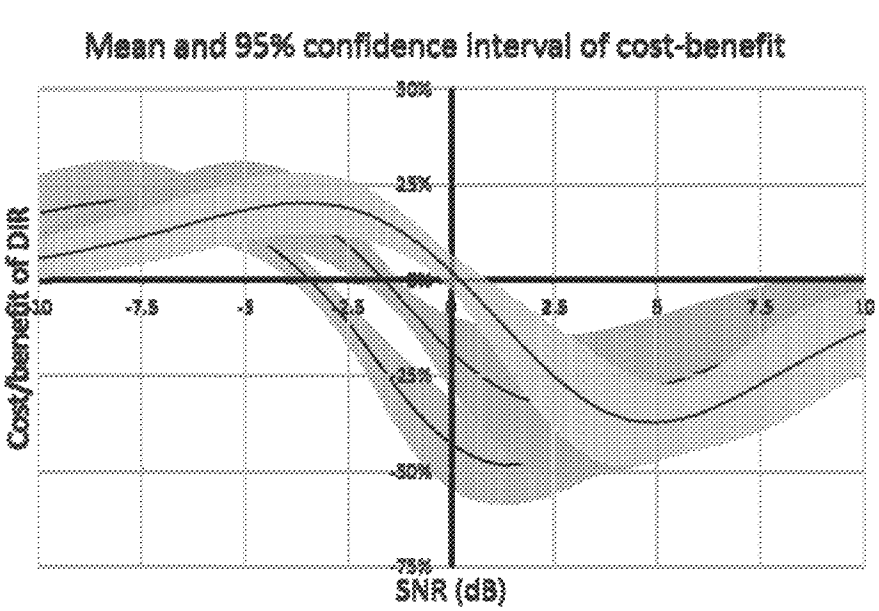
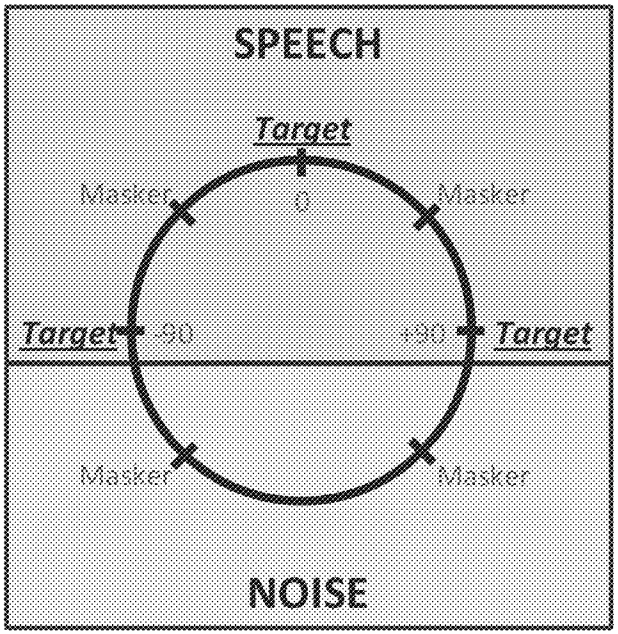
FIG. 2

Create database of corresponding environmental data, user data, and user control data

- Mount an operational hearing aid on a user.
- Connect the hearing aid to an APP of an auxiliary device, e.g. a smartphone or similar processing device.
- Pick up and analyze sound signals of a current acoustic environment of the user (by hearing aid and/or auxiliary device).
- Extract relevant parameters of the acoustic environment (average sound level, noise level, SNR, music, single talker, multi-talker, conversation, speech, no speech, estimated speech intelligibility, etc.)
- Possibly extract parameters of the physical environment (e.g. time of day; location, temperature, wind speed).
- Possibly extract parameters of the user's state (e.g. cognitive load; movement pattern; temperature, etc.).
- Automatically store corresponding values of said parameters (related to the acoustic environment, the physical environment, the user's state) together with settings of the hearing aid, which can be changed by the user (e.g. volume, program, algorithm processing parameters, etc.).

FIG. 7

PERSONALIZATION OF ALGORITHM PARAMETERS OF A HEARING DEVICE

SUMMARY

The present disclosure relates to individualization of devices, e.g. hearing aids, e.g. configuration and adaptation of parameter settings of one or more processing algorithms (also termed 'hearing instrument settings') to a particular user. Such configuration or adaptation may e.g. be based on prediction and evaluation of patient-specific "costs" and benefits of application of specific processing algorithms, e.g. noise reduction or directionality (beamforming).

There is, for example, a trade-off between the benefits of directionality and the "costs" of directionality. That is, generally speaking, that the listener will tend to benefit from it when the target is at a location that is relatively enhanced by beamforming (e.g., at the front of the listener) and to incur "costs" when attending to locations that are strongly attenuated by beamforming. To put it another way, helping systems such as directional beamforming systems can have "side effects," such as attenuating things that at least some listeners would like to attend to.

Needs and abilities vary greatly across individuals. This large variability is in part due to how diverse the causes of hearing loss can be, and in part it is a reflection of the complexity of the brain functions that support our ability to attend to one signal in the presence of other competing sounds. Causes of hearing difficulties span a broad range that includes a) cochlear damage (i.e., loss of outer hair cells and/or inner hair cells); b) damage to essential supporting mechanisms (e.g., stria vascularis degeneration); c) neural mis-development, damage and/or atrophy; and d) cognitive differences, to name just a few. The fact that needs and abilities differ so greatly across individuals has important implications for how and when the hearing aid's "helping" systems truly are of net benefit for different individuals. This is illustrated in FIG. 1. The lower right panel of the figure highlights a key point that a 'high performing person' with low Speech Reception Thresholds (SRTs) can be expected to enjoy a net benefit of beamforming at considerably lower Signal-to-Noise Ratios (SNRs) than a 'low performing person' with higher SRTs does. In particular, the high performer will incur a net cost of beamforming at SNRs where the lower performer enjoys a net benefit. This suggests that settings that help one listener will give drawbacks to another. The individual settings may include anything in the hearing aid signal processing, e.g. frequency shaping, dynamic range compression, directionality, noise reduction, anti-feedback etc. Future advanced algorithms such as deep neural networks for speaker separation and speech enhancement may also need to be set for the individual user to provide maximum benefit. Thus, we can contribute significantly to improving individual outcomes if we can better individualize how we provide help to each listener.

It has been estimated that only about 50% of the observed variance in speech understanding among hearing impaired persons can be accounted for by the respective audiograms. Solely based on an audiogram it may hence be difficult to find an optimal set of hearing instrument parameters for the particular hearing instrument user. Further, the hearing care professional (HCP) only has limited amount of time to collect additional data. Therefore, it would be beneficial if another way can be found to provide information about the user and his/her hearing abilities and/or preferences.

Further, audible and visual indicators are key hearing instrument <-> user interaction means to tell the hearing aid user what is happening in the instrument for a set of use case scenarios, e.g. program change, battery low etc., and they are becoming more and more useful. However, currently the audible indicator tones and visual indicator patterns are typically fixed for all and hardcoded into the instrument. Some of the given tones/patterns may not be suitable or understood by hearing aid users, that may affect (or even annoy) a hearing aid user's daily life. Therefore, it would be beneficial to be able to personalize such indicators to the needs of the particular user of the hearing instrument.

Further, it may be advantageous to personalize hearing aids by combining context data and sound environment information from a smartphone (or similar portable device), with user feedback in order to automatically change hearing aid (e.g. parameter) settings, e.g. based on machine learning techniques, such as learning algorithms, e.g. based on supervised or un-supervised learning, e.g. involving the use of artificial neural networks, etc.

A Method of Personalizing One or More Parameters of a Processing Algorithm for Use in a Hearing Aid In an aspect of the present application, a method of personalizing one or more parameters of a processing algorithm for use in a processor of a hearing aid for a specific user is provided. The method may comprise

- Performing a predictive test for estimating a hearing ability of the user when listening to test signals having different characteristics;
- Analyzing results of said predictive test for said user and providing a hearing ability measure for said user;
- Selecting a specific processing algorithm of said hearing aid.

The method may further comprise,

- Selecting a cost-benefit function and/or key values from one or more of its underlying psychometric functions for said specific processing algorithm related to said user's hearing ability in dependence of said characteristics of said test signals; and
- Determining, for said user, one or more personalized parameters of said specific processing algorithm in dependence of said hearing ability measure and said cost-benefit function.

Thereby an improved hearing aid for a particular user may be provided.

The method my comprise one or more of the following steps

- Furthermore, perform the predictive test in the clinic OR in daily life via smartphone;
- Perform a preference test in daily life via smartphone and use that to optimize settings;
- Combine the results of the predictive test and the preference test to provide even better individual settings.

The method may further comprise the use of deep neural networks (DNN) for signal processing or for settings adjustment.

The analysis of results of the predictive test for the user may be performed in an auxiliary device in communication with the hearing aid (e.g. a fitting system or a smartphone or similar device), or in the processor of the hearing device. The determination of personalized parameters for the user of said specific processing algorithm in dependence of said hearing ability measure and said cost-benefit function may be performed in an auxiliary device in communication with the hearing aid (e.g. a fitting system or a smartphone or similar device), or in the processor of the hearing device.

The hearing ability measure may comprise a speech intelligibility measure or a frequency discrimination measure or an amplitude discrimination measure, or a frequency selectivity measure or a temporal selectivity measure. The hearing ability measure may e.g. be frequency and/or level dependent. The speech intelligibility measure may e.g. be the 'Speech intelligibility index' (cf. e.g. [ANSI/ASA S3.5; 1997]) or any other appropriate measure of speech intelligibility, e.g. the STOI-measure (see e.g. [Taal et al.; 2010]). The frequency discrimination measure may indicate the user's ability to discriminate between two close-lying frequencies ($f_1$, $f_2$), e.g. indicated by a minimum frequency range $\Delta f_{disc}$ ($=f_2-f_1$) allowing discrimination of $f_1$ from $f_2$. The minimum frequency range $\Delta f_{disc}$ may be frequency dependent. The amplitude discrimination measure may indicate the user's ability to discriminate between two close-lying levels ($L_1$, $L_2$), e.g. indicated by a minimum level difference $\Delta L_{disc}$ ($=L_2-L_1$) allowing discrimination of $L_1$ from $L_2$. The minimum level difference $\Delta_{disc}$ may be frequency (and/or level) dependent. The amplitude discrimination measure may e.g. comprise an amplitude modulation measure. The amplitude discrimination measure may e.g. comprise a measure of the user's hearing threshold (e.g. in the form of data of an audiogram).

The different characteristics of the test signals may be represented by one or more of

- different signal-to-noise ratios (SNR);
- different modulation depths or modulation indices, or
- different detection thresholds of tones in broadband, bandlimited or band-stop noise, describing frequency selectivity,
- different detection thresholds for temporal gaps in broadband or bandlimited noise, describing temporal selectivity,
- different depths or indices of amplitude modulation as a function of modulation frequency, e.g., modulation transfer function,
- different frequency or depth of spectral modulation
- sensitivity to frequency modulation at varying center frequencies and bandwidths,
- direction of frequency modulation including e.g., discrimination of positive from negative phase of Schroeder-phase stimuli.

The method may comprise selecting a predictive test for estimating a degree of hearing ability of a user. The predictive test may be selected from the group comprising

- Spectro-temporal modulation test,
- Triple Digit Test,
- Gap detection
- Notched noise test
- TEN test
- Cochlear compression.

The 'spectro-temporal modulation (STM) test' measures a user's ability to discriminate spectro-temporal modulations of a test signal. Performance in the STM test a) can account for a considerable portion of the user's ability to understand speech (speech intelligibility), and in particular b) continues to account for a large share of the variance in speech understanding even after the factoring out the variance that can be accounted for by the audiogram, cf. e.g. [Bernstein et al.; 2013; Bernstein et al.; 2016]. STMs are defined by modulation depth (amount of modulation), modulation frequency (fm, cycles per second) and spectral density (Ω, cycles per octave).

The 'Triple Digit Test' is a speech-recognition-in-noise listening test using a spoken combinations of three digits, presented in a noise background, e.g. using ear-phones, or a loudspeaker of a hearing aid or of a pair of hearing aids, e.g. played or forwarded from an auxiliary device, e.g. a smartphone, cf. e.g. FIG. 5) to present the sound signals (cf. e.g. http://hearcom.eu/prof/DiagnosingHearingLoss/SelfScreenTests/ThreeDigitTest_en.html).

Its results correlate with hearing thresholds of the user, e.g. Speech Reception Thresholds (SRT). A version of the triple digit test form part of the Danish clinical speech in noise listening test, 'Dantale'. In this test, the Danish digits: 0, 1, 2, 3, 5, 6, 7, and 12 are used to form 60 different triplets, arranged in three sections. The individual digits are acoustically identical and the interval between digits in a triplet is 0.5 s (cf. e.g. [Elberling et al.; 1989]). In the present context, the term 'Triple Digit Test' is used as a general term to refer to tests in which the listener is presented 3 digits and has the task of identifying which digits were presented. This can include, among others, versions in which the outcome measure is a threshold and versions in which is percentage or proportion of digits identified correctly.

The notched noise test is used to assess frequency selectivity. A target tone is presented in the presence of a masking noise with a notch (i.e., a spectral gap) and the width of the notch is varied and the threshold for detecting a pure tone is measured as a function of notch width.

The TEN (Threshold Equalizing Noise) test is used to identify cochlear dead regions. A target, typically a pure tone, is presented in the suspected dead region and a masking noise is presented at adjacent frequencies in order to inhibit detection of the target via off-frequency listening.

The processing algorithm may comprise one or more of a noise reduction algorithm, a directionality algorithm, a feedback control algorithm, a speaker separation and a speech enhancement algorithm.

The method may form part of a fitting session wherein the hearing aid is adapted to the needs of the user. The method may e.g. be performed by an audiologist while configuring a specific hearing instrument to a specific user, e.g. by adapting parameter settings to the particular needs of the user. Different parameter settings may be related to different processing algorithms, e.g. noise reduction (e.g. to be more or less aggressive), directionality (e.g. to be activated at larger or smaller noise levels), feedback control (e.g. adaptation rates to be smaller of larger in dependence of the user's expected acoustic environments), etc.

The step of performing a predictive test may comprise

Initiating a test mode of an auxiliary device;

Executing said predictive test via said auxiliary device.

The auxiliary device may comprise a remote control device for the hearing aid or a smartphone. The auxiliary device may form part of a fitting system for configuring the hearing aid (e.g. parameters of processing algorithms) to the specific needs of the user. The hearing aid and the auxiliary device are adapted to allow the exchange of data between them. The auxiliary device may be configured to execute an application (APP) from which the predictive test is initiated. The predictive test may e.g. be a triple digit test or a Spectro-temporal modulation (STM) test.

The step of performing a predictive test may be initiated by the user. The predictive test may be executed via an application program (APP) running on the auxiliary device. The predictive test may be executed by a fitting system in communication with or forming part of or being constituted by said auxiliary device. The step of Initiating a test mode of an auxiliary device may be performed by the user. The predictive test may be initiated by a hearing care professional (HCP) via the fitting system during a fitting session of the hearing aid, where parameters of one or more processing algorithm(s) of the processor are adapted to the needs of the user.

A Hearing Device:

In an aspect, a hearing aid configured to be worn at or in an ear of a user and/or for being at least partially implanted in the head of a user is furthermore provided by the present application. The hearing aid may comprise a forward path for processing an electric input signal representing sound provided by an input unit, and for presenting a processed signal perceivable as sound to the user via an output unit, the forward path comprising a processor for performing said processing by executing one or more configurable processing algorithms. The hearing aid may be adapted so that parameters of said one or more configurable processing algorithms are personalized to the specific needs of the user according to the method of claim 1 (or as described above).

The hearing aid may be constituted by or comprise an air-conduction type hearing aid, a bone-conduction type hearing aid, a cochlear implant type hearing aid, or a combination thereof.

The hearing device may be adapted to provide a frequency dependent gain and/or a level dependent compression and/or a transposition (with or without frequency compression) of one or more frequency ranges to one or more other frequency ranges, e.g. to compensate for a hearing impairment of a user. The hearing device may comprise a signal processor for enhancing the input signals and providing a processed output signal.

The hearing device may comprise an output unit for providing a stimulus perceived by the user as an acoustic signal based on a processed electric signal. The output unit may comprise a number of electrodes of a cochlear implant (for a CI type hearing device) or a vibrator of a bone conducting hearing device. The output unit may comprise an output transducer. The output transducer may comprise a receiver (loudspeaker) for providing the stimulus as an acoustic signal to the user (e.g. in an acoustic (air conduction based) hearing device). The output transducer may comprise a vibrator for providing the stimulus as mechanical vibration of a skull bone to the user (e.g. in a bone-attached or bone-anchored hearing device).

The hearing device may comprise an input unit for providing an electric input signal representing sound. The input unit may comprise an input transducer, e.g. a microphone, for converting an input sound to an electric input signal. The input unit may comprise a wireless receiver for receiving a wireless signal comprising or representing sound and for providing an electric input signal representing said sound. The wireless receiver may e.g. be configured to receive an electromagnetic signal in the radio frequency range (3 kHz to 300 GHz). The wireless receiver may e.g. be configured to receive an electromagnetic signal in a frequency range of light (e.g. infrared light 300 GHz to 430 THz, or visible light, e.g. 430 THz to 770 THz).

The hearing device may comprise a directional microphone system adapted to spatially filter sounds from the environment, and thereby enhance a target acoustic source among a multitude of acoustic sources in the local environment of the user wearing the hearing device. The directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing device may be or form part of a portable (i.e. configured to be wearable) device, e.g. a device comprising a local energy source, e.g. a battery, e.g. a rechargeable battery. The hearing device may e.g. be a low weight, easily wearable, device, e.g. having a total weight less than 100 g, e.g. less than 20 g.

The hearing device may comprise a forward or signal path between an input unit (e.g. an input transducer, such as a microphone or a microphone system and/or direct electric input (e.g. a wireless receiver)) and an output unit, e.g. an output transducer. The signal processor is located in the forward path. The signal processor is adapted to provide a frequency dependent gain according to a user's particular needs. The hearing device may comprise an analysis path comprising functional components for analyzing the input signal (e.g. determining a level, a modulation, a type of signal, an acoustic feedback estimate, etc.). Some or all signal processing of the analysis path and/or the signal path may be conducted in the frequency domain. Some or all signal processing of the analysis path and/or the signal path may be conducted in the time domain.

The hearing device may be configured to operate in different modes, e.g. a normal mode and one or more specific modes, e.g. selectable by a user, or automatically selectable. A mode of operation may be optimized to a specific acoustic situation or environment. A mode of operation may include a low-power mode, where functionality of the hearing device is reduced (e.g. to save power), e.g. to disable wireless communication, and/or to disable specific features of the hearing device. A mode of operation may be a directional mode or an omni-directional mode.

The hearing device may comprise a number of detectors configured to provide status signals relating to a current physical environment of the hearing device (e.g. the current acoustic environment), and/or to a current state of the user wearing the hearing device, and/or to a current state or mode of operation of the hearing device. Alternatively, or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

The hearing device may comprise a voice activity detector (VAD) for estimating whether or not (or with what probability) an input signal comprises (e.g. includes) a voice signal (at a given point in time). The hearing device may comprise an own voice detector for estimating whether or not (or with what probability) a given input sound (e.g. a voice, e.g. speech) originates from the voice of the user of the system.

The number of detectors may comprise a movement detector, e.g. an acceleration sensor. The movement detector is configured to detect movement of the user's facial muscles and/or bones, e.g. due to speech or chewing (e.g. jaw movement) and to provide a detector signal indicative thereof.

The hearing device may comprise a classification unit configured to classify the current situation based on input signals from (at least some of) the detectors, and possibly other inputs as well. In the present context 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

The classification unit may be based on or comprise a neural network, e.g. a trained neural network.

The hearing device may comprise an acoustic (and/or mechanical) feedback control (e.g. suppression) or echo-cancelling system.

The hearing device may further comprise other relevant functionality for the application in question, e.g. compression, noise reduction, etc.

The hearing device may comprise a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof. The hearing assistance system may comprise a speakerphone (comprising a number of input transducers and a number of output transducers, e.g. for use in an audio conference situation), e.g. comprising a beamformer filtering unit, e.g. providing multiple beamforming capabilities.

Use:

In an aspect, use of a hearing device as described above, in the 'detailed description of embodiments' and in the claims, is moreover provided. Use may be provided in a system comprising one or more hearing aids (e.g. hearing instruments), headsets, ear phones, active ear protection systems, etc., or combinations thereof A Computer Readable Medium or Data Carrier:

In an aspect, a tangible computer-readable medium (a data carrier) storing a computer program comprising program code means (instructions) for causing a data processing system (a computer) to perform (carry out) at least some (such as a majority or all) of the (steps of the) method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Other storage media include storage in DNA (e.g. in synthesized DNA strands). Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

The hearing system is adapted to establish a communication link between the hearing device and the auxiliary device to provide that information (e.g. control and status signals, possibly audio signals) can be exchanged or forwarded from one to the other.

The auxiliary device may comprise a remote control, a smartphone, or other portable or wearable electronic device, such as a smartwatch or the like.

The auxiliary device may be constituted by or comprise a remote control for controlling functionality and operation of the hearing device(s). The function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

The auxiliary device may be constituted by or comprise an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

The auxiliary device may be constituted by or comprise another hearing device. The hearing system may comprise two hearing devices adapted to implement a binaural hearing system, e.g. a binaural hearing aid system.

The hearing system may comprise a hearing aid and an auxiliary device, the hearing system being adapted to establish a communication link between the hearing aid and the auxiliary device to provide that data can be exchanged or forwarded from one to the other, wherein the auxiliary device is configured to execute an application implementing a user interface for the hearing aid and allowing a predictive test for estimating a hearing ability of the user to be initiated by the user and executed by the auxiliary device including a) playing sound elements of said predictive test via a loudspeaker, e.g. of the auxiliary device, or b) transmitting sound elements of said predictive test via said communication link to said hearing device for being presented to the user via an output unit of the hearing aid, and wherein the user interface is configured to receive responses of the user to the predictive test, and wherein the auxiliary device is configured to store said responses of the user to the predictive test.

The auxiliary device may comprise a remote control, a smartphone, or other portable or wearable electronic device, such as a smartwatch or the like.

The auxiliary device comprises or form part of a fitting system for adapting the hearing aid to a particular user's needs. The fitting system and the hearing aid are configured to allow exchange of data between them, e.g. to allow different (e.g. personalized) parameter settings to be forwarded from the fitting system to the hearing aid (e.g. to the processor of the hearing aid).

The auxiliary device may be configured to estimate a speech reception threshold of the user from the responses of the user to the predictive test. The speech reception threshold (SRT) (or speech recognition threshold) is defined as the sound pressure level at which 50% of the speech is identified correctly. One can also choose to run measures that target something other than 50% correct. Other performance levels that are commonly measured include, for example, 70% and 80% correct.

The auxiliary device may be configured to execute the predictive test as a triple digit test where sound elements of said predictive test comprise digits a) played at different signal to noise ratios, or b) digits played at a fixed signal to noise ratio, but with different hearing aid parameters, such as different compression or noise reduction settings.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. The APP is configured to run on cellular phone, e.g. a smartphone, or on another portable device allowing communication with said hearing device or said hearing system.

The non-transitory application may be configured to allow a user to perform one or more, such as a majority or all, of the following steps

- select and initiate a predictive test for estimating a hearing ability of the user when listening to test signals having different characteristics;
- initiate an analysis of results of said predictive test for said user and providing a hearing ability measure for said user;
- select a specific processing algorithm of said hearing aid,
- select a cost-benefit function and/or key values from one or more of its underlying psychometric functions for said algorithm related to said user's hearing ability in dependence of said different characteristics of said test signals; and
- determine, for said user, one or more personalized parameters of said processing algorithm in dependence of said hearing ability measure and said cost-benefit function.

The non-transitory application may be configured to allow a user to apply the personalized parameters to the processing algorithm.

The non-transitory application may be configured to allow a user to

- check the result of said personalized parameters when applied to an input sound signal provided by an input unit of the hearing aid and when the resulting signal is played for the user via an output unit of the hearing aid;
- accept or reject the personalized parameters.

Definitions

In the present context, a hearing aid, e.g. a hearing instrument, refers to a device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing aid may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing aid may comprise a single unit or several units communicating (e.g. acoustically, electrically or optically) with each other. The loudspeaker may be arranged in a housing together with other components of the hearing aid, or may be an external unit in itself (possibly in combination with a flexible guiding element, e.g. a dome-like element).

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing aids, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output unit may comprise an output transducer, such as e.g. a loudspeaker for providing an air-borne acoustic signal or a vibrator for providing a structure-borne or liquid-borne acoustic signal. In some hearing aids, the output unit may comprise one or more output electrodes for providing electric signals (e.g. to a multi-electrode array) for electrically stimulating the cochlear nerve (cochlear implant type hearing aid).

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window. In some hearing aids, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing aid may be adapted to a particular user's needs, e.g. a hearing impairment. A configurable signal processing circuit of the hearing aid may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing aid via an interface to a programming device (fitting system), and used by a processing algorithm executed by the configurable signal processing circuit of the hearing aid.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Such auxiliary devices may include at least one of a remote control, a remote microphone, an audio gateway device, an entertainment device, e.g. a music player, a wireless communication device, e.g. a mobile phone (such as a smartphone) or a tablet or another device, e.g. comprising a graphical interface. Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person. Hearing aids or hearing systems may e.g. form part of or interact with public-address systems, active ear protection systems, handsfree telephone systems, car audio systems, entertainment (e.g. TV, music playing or karaoke) systems, teleconferencing systems, classroom amplification systems, etc.

Embodiments of the disclosure may e.g. be useful in applications such as hearing aids.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

FIG. 2 shows in the left side, a test scenario as also illustrated in FIG. 1 and in the right side, different cost-benefit curves as a function of SNR for a directional algorithm (MVDR) exhibiting off-axis "costs" and on-axis "benefits".

FIG. 7 shows a method of generating a database for training an algorithm (e.g. a neural network) for adaptively providing personalized parameter settings of a processing algorithm of a hearing aid.

The figures are schematic and simplified for clarity, and they just show details which are essential to the understanding of the disclosure, while other details are left out. Throughout, the same reference signs are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include micro-electronic-mechanical systems (MEMS), integrated circuits (e.g. application specific), microprocessors, microcontrollers, digital signal processors (DSPs), field programmable gate arrays (FPGAs), programmable logic devices (PLDs), gated logic, discrete hardware circuits, printed circuit boards (PCB) (e.g. flexible PCBs), and other suitable hardware configured to perform the various functionality described throughout this disclosure, e.g. sensors, e.g. for sensing and/or registering physical properties of the environment, the device, the user, etc. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids.

Figure 1:
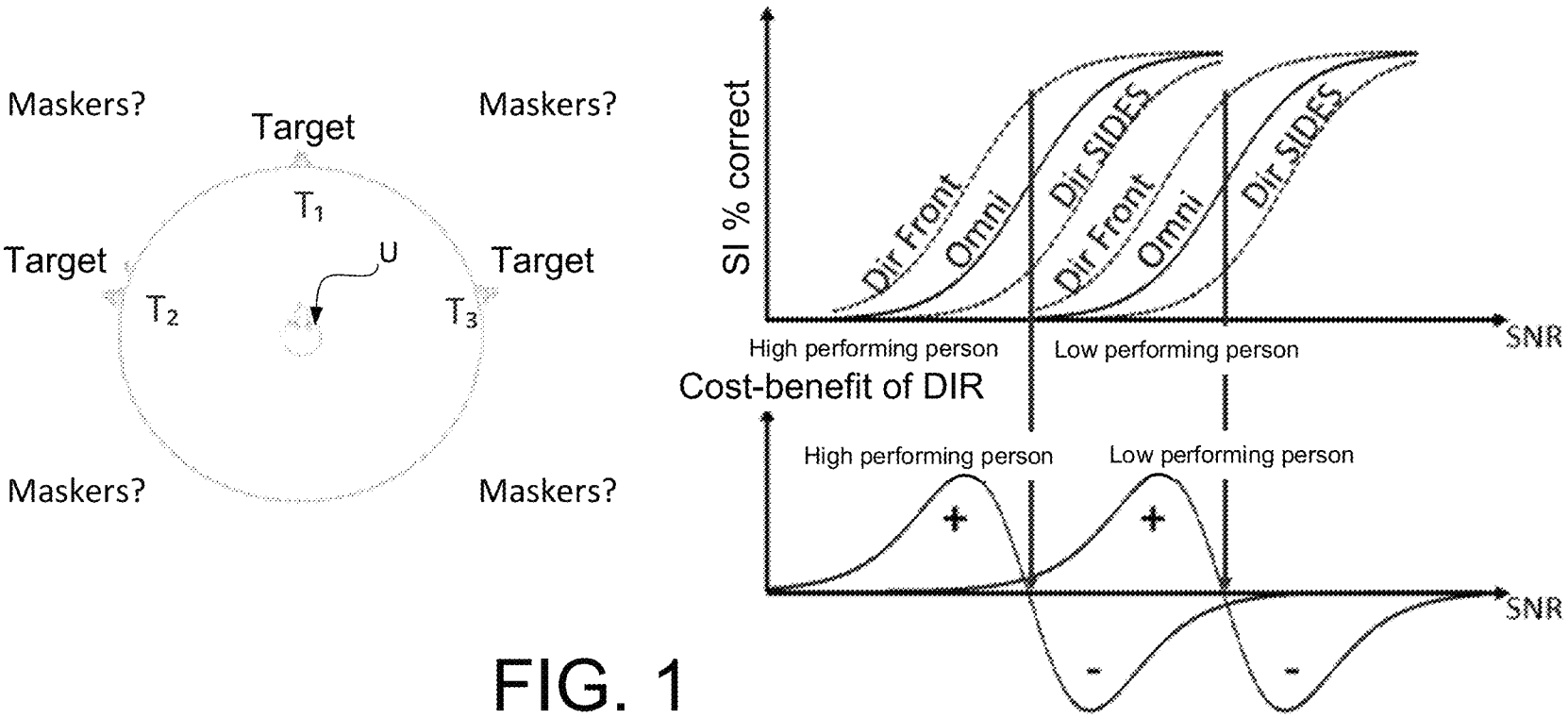
FIG. 1 schematically illustrates in the top graph how the effect of a directionality algorithm may affect speech intelligibility for a high performing and a low performing person (in this example with respect to understanding of speech in noise), respectively, as a function of signal to noise ratio (SNR), and in the bottom graph schematically illustrates that a high performing listener with low SRTs can be expected to enjoy a net benefit of beamforming at considerably lower SNRs than a lower performing listener with higher SRTs does.

FIG. 1 shows in the left part an experimental setup where a user (U) is exposed to a target signal ('Target') from three different directions ($T_1$ (Front) $T_2$ (Left), $T_3$ (Right)) and with noise signals ('Maskers?') distributed at various locations around the user. FIG. 1 shows in the top right graph how the effect of a directionality algorithm may affect speech intelligibility for a high performing and a low performing person (in this example with respect to understanding of speech in noise), respectively, as a function of signal to noise ratio (SNR). The bottom graph schematically illustrates that a high performing listener with low SRTs can be expected to enjoy a net benefit of beamforming at considerably lower SNRs than a lower performing listener with higher SRTs does. FIG. 1 together illustrates that the directional system (ideally) should be activated at different SNRs for different individual users.

The present disclosure proposes to apply a cost-benefit function as a way of quantifying each individual's costs and benefits of helping systems. The present disclosure further discloses a method for using predictive measures in order to achieve better individualization of the settings for the individual patient.

Cost-Benefit Function:

In the example in the FIG. 1 the cost-benefit function is estimated as the improvement due to directionality for targets from the front minus the decrement due to directionality for off-axis (side) targets.

As seen in FIG. 1, the crossing point where the listener goes from a net benefit to a net "cost" differs from individual to individual (depending on the individuals' hearing capability).

The cost-benefit function may relate to many aspects of hearing aid outcome, benefit, or 'quality', e.g. speech intelligibility, sound quality and listening effort, etc.

Note that the illustration at the upper right of FIG. 1 includes a simplification in which the listener's understanding of speech in an Omni is shown as a single psychometric function, even though in practice there can be separate psychometric functions for targets from the front vs. targets from the side.

Predictive Measures:

Predictive measures may e.g. include psychoacoustic tests, questionnaires, subjective evaluations by a hearing care professional (HCP) and/or patient, etc.

Potential predictive tests include, but are not limited to the following:

- Spectro-temporal modulation (STM) test
- Triple Digit Test
- Personal preference questionnaire
- Listening preference questionnaire
- HCP slider or similar HCP assessment tool
- Client slider or similar client self-assessment tool
- Acceptable noise level test
- SWIR test
- Listening effort assessment
- Reading Span test
- Test of Everyday Attention
- Auditory Verbal Learning Test
- Text Reception Threshold
- Other cognitive assessment tests
- Speech-in-noise test
- SNR loss assessment
- Temporal fine structure sensitivity
- Temporal modulation detection
- Frequency selectivity
- Critical bandwidth
- Notched-noise bandwidth estimation
- Threshold Equalizing Noise (TEN) test (se e.g. [Moore et al.; 2000]).
- Spectral ripple discrimination
- Frequency modulation detection
- Gap detection
- Cochlear compression estimates
- Questionnaires: SSQ
- Questionnaires: Self-reported handicap
- Binaural masked detection
- Lateralization
- Listening effort
- Spatial awareness test
- Spatial localization test(s)
- Test of apparent source width
- Demographic information such as age, gender, languages spoken by patient, etc.

Predictive measures are e.g. used to estimate the individual patient's need for help and to adjust the patient's settings of corresponding processing algorithms accordingly. Such assessment may e.g. be made during a fitting session where hearing aid processing parameters are adapted to the individual persons' needs.

An assessment of where (e.g. at which SNR) an individual patient's cost-benefit function crosses over from net benefit to net cost may be performed according to the present disclosure.

In the following aspects of the present disclosure are exemplified in the context of a directionality algorithm. However, this approach is also intended for other helping systems such as noise reduction, etc.

In the present example, the benefits and costs are measured in the domain of speech intelligibility (SI) (benefits are measured as increase in SI, costs as a decrease in SI). The benefits and costs with respect to speech intelligibility may be measured by evaluating specific listening tests for a given user wearing hearing aid(s) with parameter settings representing different modes operation of the directional system (e.g. under different SNR).

However, this approach is also intended for use with a wide range of outcome measures, e.g. including, but not limited to:

The cognitive load listening places on the patient
Listening effort
Mental energy
Ability to remember what was said
Spatial awareness
Spatial perception
The patient's perception of sound quality
The patient's perception of listening comfort FIG. 2 shows in the left side, a test scenario as also illustrated in FIG. 1 and in the right side, different cost-benefit curves as a function of SNR for a directional algorithm (MVDR) exhibiting off-axis "costs" and on-axis "benefits". The vertical axis represents the relative benefit of an outcome measure, e.g. speech intelligibility benefit measured with and without the helping system as increase in percentage of words repeated correctly in a listening test.

In other words, FIG. 2 illustrates a method for quantifying trade-offs between, on the one hand, preserving a rich representation of the sound environment all around the listener and, on the other hand, offering enhanced focus on a target of interest that the listener may struggle to understand as the situation becomes challenging. One thing we see from the curves in this figure is that each individual has a region where the function is negative and a region where the function is positive. We also see that the positive region lies more leftward along the SNR axis and the negative region lies more rightward; that is, the positive region is always in more adverse conditions (in this example, lower SNRs) than the negative region. Moreover, this method provides an analytical tool that we can use to find where a given individual crosses over from negative to positive (i.e., benefit). It is important to highlight the individual nature of this method: it calculates individualized functions and diagnoses the needs of different listeners differently.

FIG. 2 represents a way of modeling access to off-axis sounds. With directionality on (e.g. an MVDR beamformer) with the beampattern directed towards the front (e.g. $\theta=0°$, see left part of FIG. 2), an increased speech intelligibility is observed 'on-axis' (front), i.e. with the target impinging on the user from the front, and a reduced speech intelligibility is observed 'off-axis' (e.g. $\theta=+90°$ or $-90°$, see left part of FIG. 2), i.e. with the target impinging on the user from one of the sides. At high SNRs: negative cost/benefit, at low SNRs: positive cost/benefit.

While the approach described above has value for optimizing hearing aid fitting for the individual, constraints on time and on the equipment available across audiological clinics will most likely require that we apply this method indirectly via a predictive test rather than take the direct approach of calculating full cost-benefit functions for each patient. The reason for choosing this indirect method (i.e., use of a predictive test) is that in clinical practice it is rarely if ever possible to collect the large amount of data needed to calculate full cost/benefit functions for all patients. Thus, one uses a predictive test that is correlated with one or more key features of cost/benefit; this could include but is not limited to the zero-crossing point of the cost-benefit function or an identifying feature or features of one or more of the psychometric functions from which the cost-benefit function is derived. One does this by collecting data on a test population for the cost-benefit analysis described above as well as for predictive tests and then identifying good predictive tests with the help of correlational analysis. The predictive tests could include, for example, the Triple Digit Test, Spectro-Temporal Modulation Test and others.

Figure 3:
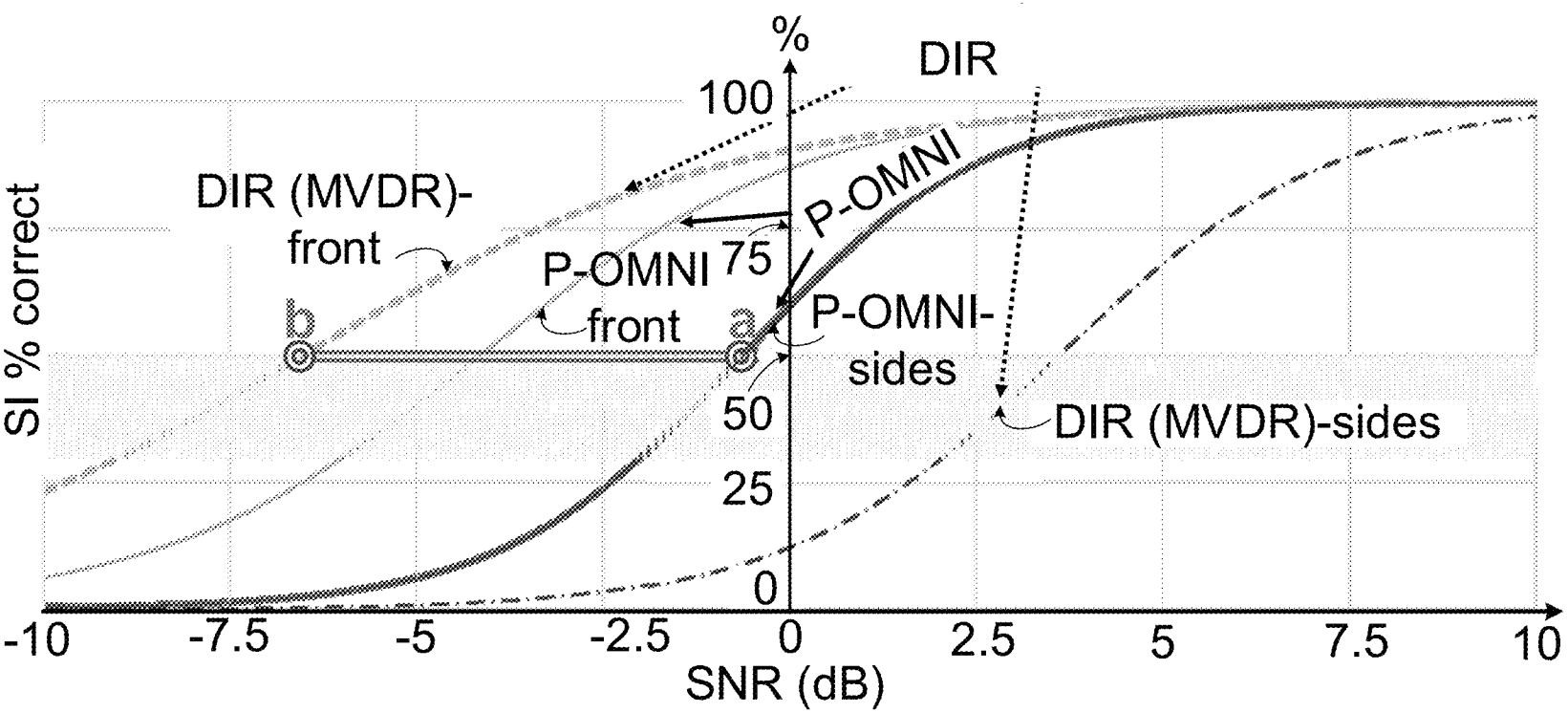
FIG. 3 shows speech intelligibility (% correct [0%; 100%]) versus SNR for different listening situations [−10 dB; +10 dB] for a hearing impaired user a) using front-directed beampattern (DIR-front) with target at the front; b) using Pinna-OMNI (P-OMNI) with target at the front; c) using Pinna-OMNI with target at the one of the sides; and d) using front-directed beampattern (DIR-front) with target at the one of the sides.

FIG. 3 shows speech intelligibility (% correct [0%; 100%]) versus SNR for different listening situations [−10 dB; +10 dB] for a hearing impaired user 1) using front-directed beampattern (DIR-front) with target at the front; 2) using Pinna-OMNI (P-OMNI) with target at the front; 3) using Pinna-OMNI with target at the one of the sides; and 4) using front-directed beampattern (DIR-front) with target at the one of the sides.

The SNR range is exemplary and may vary according to the specific application or acoustic situation.

Measuring Thresholds in Predictive Test

A method of estimating thresholds may comprise the following steps.

- Run predictive test (e.g. the Triple Digit Test and/or a Spectro-temporal modulation (STM) test);
- Vary the input parameter (e.g., modulation depth for STM or SNR for the Triple Digit Test);
- Find threshold (e.g. as the modulation depth or SNR for which the listener achieves a pre-determined target level of performance, where possible target levels of performance could be 50% correct, 80% correct or other).

The Triple Digit Test is sometimes also called "digits-in-noise" test. Target sounds are 3 digits, e.g., "2" . . . "7" . . . "5". SNR may be varied by varying the level of one or more 'Masker sounds', e.g. modulated noise, a recorded scene or other.

Mapping Predictive Test to Automatics

An aim of the present disclosure is to give the hearing aid user access to sound around the user without removing sound if not considered necessary from a perception (e.g. speech intelligibility) point of view as regards a target (speech) signal.

A speech intelligibility of 50% understanding may be considered as a key marker (e.g. defining Speech Reception Thresholds (SRT)). It may also serve as a marker of when the listener has access to sounds, a view that may be supported by pupillometry data. If we use the region around 50% intelligibility in this way, then from FIG. 3 we would treat "a" as the point at which the scene has become so challenging that the listener has to a significant degree "lost access" to targets from the side in an omnidirectional setting and that "b" is the point at which the listener has to a significant degree "lost access" to targets from the front in full MVDR. By this logic it is suggested to begin transitioning out of an omnidirectional setting at "a" or lower and to reach full MVDR at "b" or higher. Transition (a minus b) indicates a region of several dB within which one would wish to transition a listener from a full omni-setting to the maximum directional setting.

1. An Example, Providing Personalization Data:

In the following, alternative or supplementary schemes for collecting data, which can be used to fine tune (e.g. personalize) the parameters in the hearing instrument, are outlined.

Modern hearing devices do not necessarily only consist of hearing instruments attached to the ears, but may also include or be connected to additional computational power, e.g. available via auxiliary devices such as smartphones. Other auxiliary devices, e.g. tablets, laptops, and other wired or wirelessly connected communication devices may be available too as resources for the hearing instrument(s). Audio signals may be transmitted (exchanged) between the hearing instruments and auxiliary devices, and the hearing instruments may be controlled via a user interface, e.g. a touch display, on the auxiliary devices.

It is proposed to use training sounds to fine tune the settings of the hearing instruments. The training sounds may e.g. represent acoustic scenes, which the listener finds difficult. Such situations may be recorded by the hearing instrument microphones, and wirelessly transmitted to the auxiliary device. The auxiliary device may analyse the recorded acoustic scene and suggest one or more improved sets of parameters to the hearing instrument, which the listener may listen to and compare to the sound processed by a previous set of parameters. Based on a (e.g. by the user) chosen set of parameters, a new set of parameters may be proposed (e.g. by the hearing instrument or the auxiliary device) and compared to the previous set of parameters. Hereby, based on the feedback from the listener, an improved set of processing parameters may be stored in the hearing instrument and/or applied whenever a similar acoustic environment is recognized. The final improved set of processing parameters may be transmitted back to the auxiliary device to allow it to update its recommendation rules, based on this user feedback.

Another proposal is to estimate the hearing aid user's ability to understand speech. Speech intelligibility tests are usually too time consuming to do during the hearing instrument fitting, but a speech intelligibility test and/or other predictive tests can as well be made available via an auxiliary device, hereby enabling the hearing instrument user to find his or her speech reception threshold (SRT). Based on the estimated or predicted speech reception threshold as well as the audiogram, the hearing instrument parameters (such as e.g. the aggressiveness of the noise reduction system) can be fine-tuned to the individual listener. Such a predictive test (e.g. the 'triple digit test' or a 'Spectro-temporal modulation'-(STM-) test) can be performed with several different kinds of background noise, representing different listening situations. In this way hearing aid settings can be optimised to ensure the best speech intelligibility in many different situations.

Other proposals involve measuring the listener's ability to localize sound sources simulated by the hearing aids, or his/her preferences for noise suppression and/or reverberation suppression, or his/her ability to segregate several sound sources etc.

Figure 4:
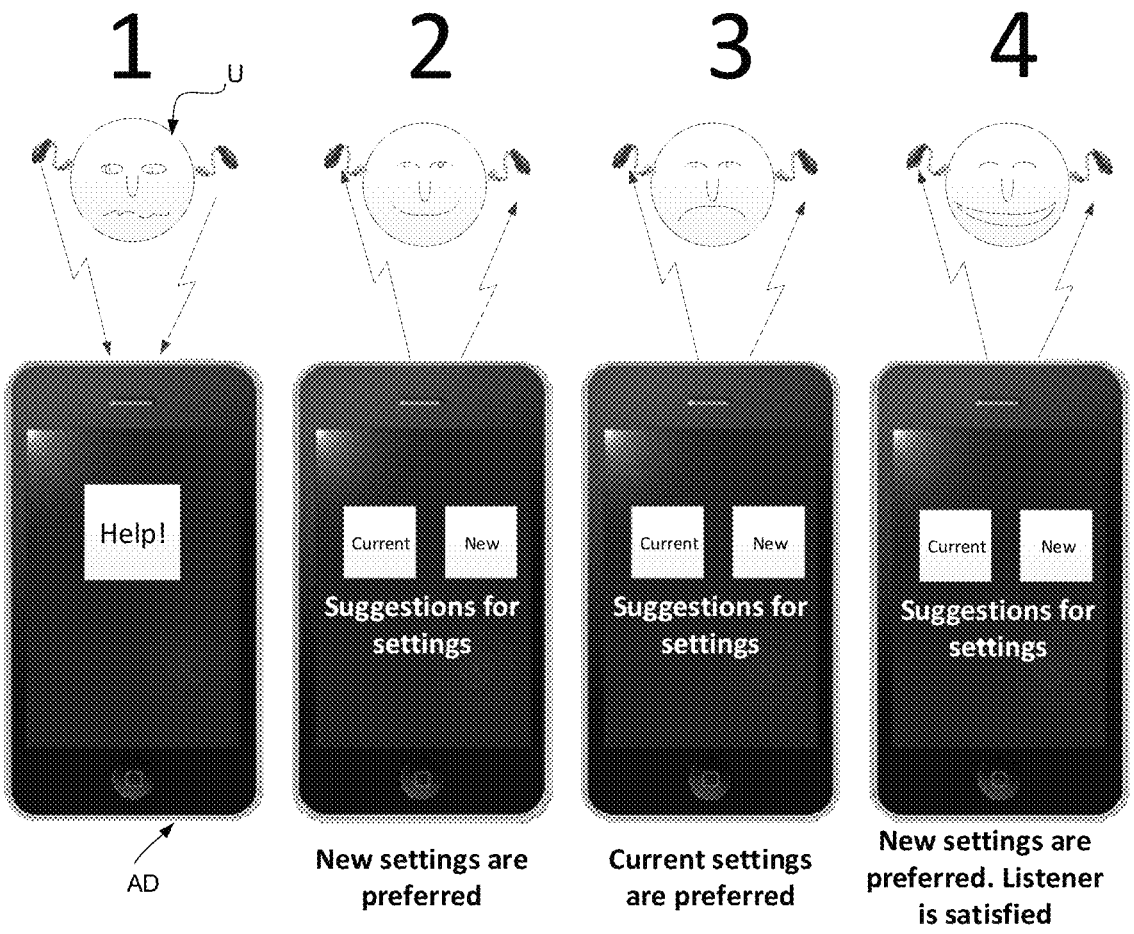
FIG. 4 shows an example illustrating how settings/parameters in the hearing instruments may be updated, e.g. via an APP of an auxiliary device.

FIG. 4 shows an example illustrating how settings/parameters in the hearing instruments may be updated, e.g. via an APP of an auxiliary device. Whenever a listener finds an acoustic scene difficult, see (1) in FIG. 4, the user may choose to record a snippet (time segment) of preferably all of the hearing aid microphones, transmit and store the sounds in the auxiliary device (alternatively, the hearing instruments continuously transmit the sounds to the auxiliary device which will be stored in a buffer, e.g. a circular (first in, first out (FIFO)) buffer). Based on the stored sound, a new set of settings for the hearing instrument will be proposed, and the listener will be prompted to choose between listening to the sound processed either with the new or the current settings. The listener may then select if the proposed settings are preferred over the current settings, see (2) in FIG. 4. Whenever the new settings are preferred, the current settings will be updated. The procedure may be repeated several times, see (3), (4) in FIG. 4, each time the listener will be able to choose between current and new settings, until the user is satisfied. The setting may be used as general settings in the instrument or the settings may be recalled whenever a similar acoustic scene is detected. The processing with the settings may either take place in the hearing instruments, where the sound snippets are transmitted back into the hearing instruments or the processing may take place in the auxiliary device, which then are mimicking the hearing instrument processing. Hereby, only the processed signals are transmitted to the hearing instrument and directly presented to the listener.

Figure 5:
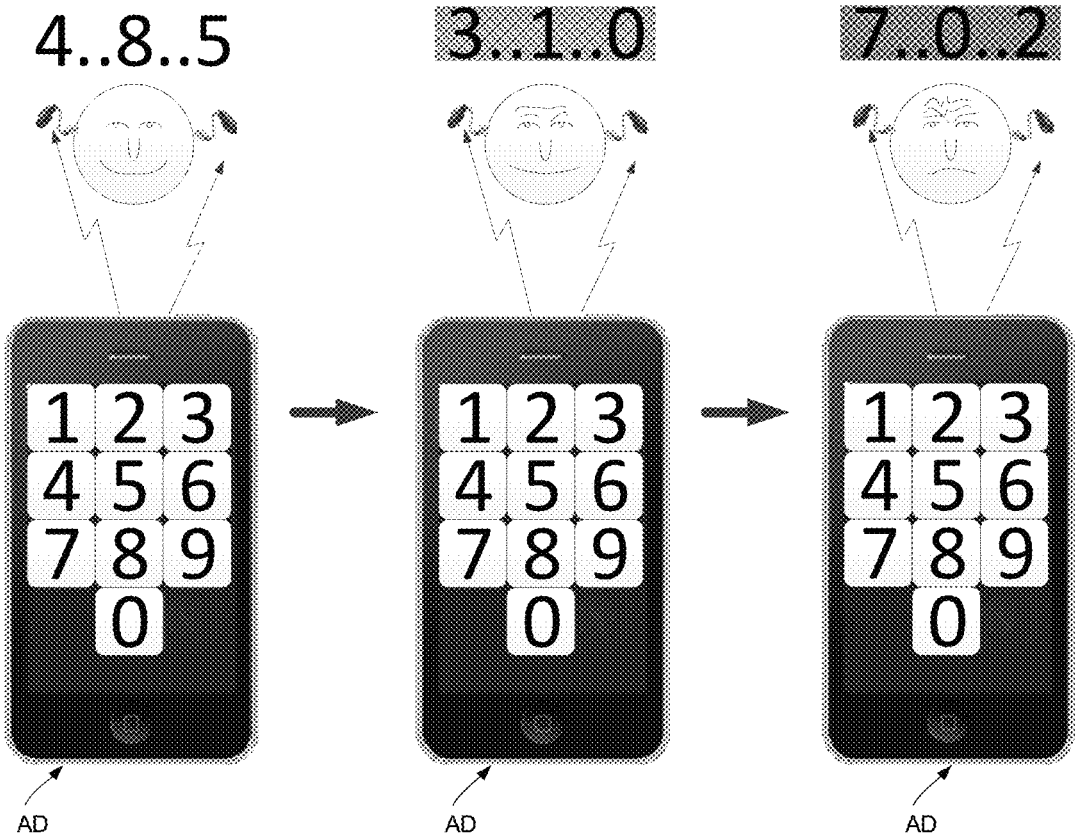
FIG. 5 shows an APP running on an auxiliary device able to perform a speech intelligibility test.

FIG. 5 shows an APP running on an auxiliary device able to perform a speech intelligibility test. The test could be of many types, but one that is very straightforward to illustrate with the use of FIG. 5 is e.g. a digit recognition test (e.g. the 'triple digit test'), where the listener has to repeat different digits ('4, 8, 5', and '3, 1, 0', and '7, 0, 2', respectively, in FIG. 5), which may be wirelessly transmitted to the hearing instruments and presented to the listener at different signal to noise ratios (via the output unit(s), e.g. loudspeaker(s)) of the hearing aid (the different digits may instead be played by a loudspeaker of the auxiliary device, and picked up by microphone(s) of the hearing aid(s)). Hereby it becomes possible to estimate the speech reception threshold (SRT) and a psychometric function, which in connection with the audiogram can be used to fine tune the hearing aid settings. As an alternative to playing the digits at different signal to noise ratios, one may also consider presenting the digits at a fixed signal to noise ratio, but with different hearing aid parameters such as different compression or noise reduction settings, hereby fine tuning the hearing instrument fitting.

The personalization decision may be based on supervised learning (e.g. a neural network). The personalization parameters (e.g. the amount of noise reduction) may e.g. be determined by a trained neural network, where the input features are a set of predictive measures (e.g. measured SRTs, an audiogram, etc.).

The joint input/preferred settings (e.g. obtained as exemplified in FIG. 4) and other user specific parameters obtained elsewhere (e.g. SRTs, audiogram data, etc.) may be used as a training set for a neural network in order to predict personalized settings.

Related to FIG. 4, an aspect of the present disclosure relates to a hearing aid (or an APP) configured to store a time segment, e.g. the last 20 seconds, of the input signal in a buffer. Whenever the listener finds that the situation is difficult (or may contain too many processing artefacts), the sound may be repeated with a more aggressive/less aggressive setting. Hereby, over time, the instrument may learn the preferred settings of the user in different situations.

2. An Example, Personalization of Hearing Aid Indicators:

A scheme for allowing a hearing aid user to select and personalize the tones/patterns of a hearing aid to his or her liking is proposed in the following. This can be done either during fitting of the hearing aid to the user's needs (e.g. at a hearing care professional (HCP)), or after fitting, e.g. via an APP of a mobile phone or other processing device (e.g. a computer). A collection of tones and LED patterns may be made available (e.g. in the cloud or in a local device) to the user. The user may browse, select and try out a number of different options (tone and LED patterns), before choosing the preferred ones. The selected (chosen) ones are then stored in the hearing aid of the user, replacing possible default ones. The user may further be allowed to compose and generate own audio (e.g. tone patterns, music or voice clips) and/or visual (e.g. LED) patterns. This approach allows the user to select the set of personal interested indicators with personalized indicator patterns, and further it enables more use cases than what are known today, for example, but not limited to:

- Configure and personalize indicators for health alerts or other notifications (utilizing hearing instrument sensors info or AI predict info (AI=Artificial Intelligence)),
- Integrated with "if this then that" (IFTTT) so that the personalized events can trigger the indicators.

Figure 6:
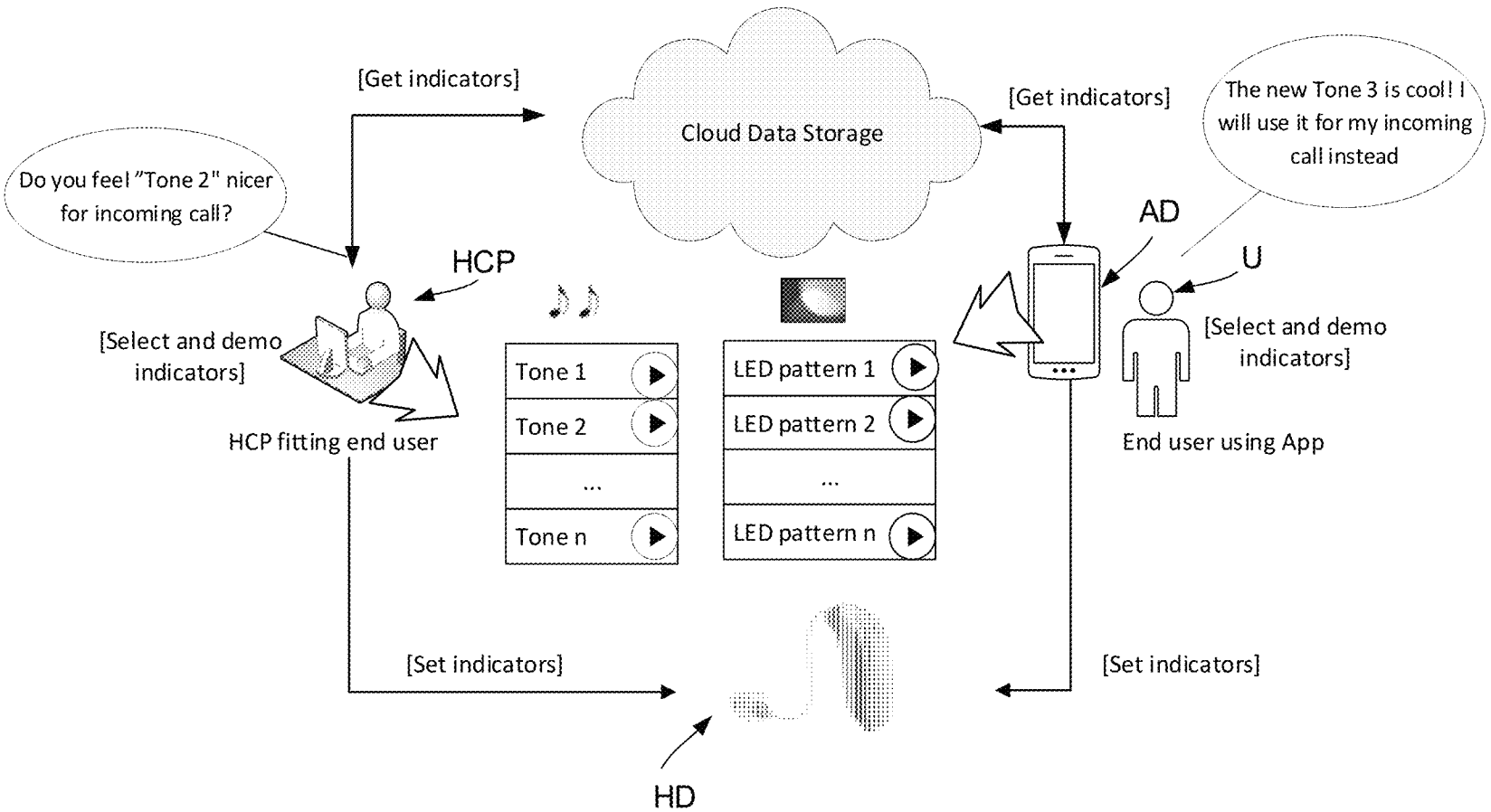
FIG. 6 shows an embodiment of a scheme for personalizing audible or visual indicators in a hearing aid according to the present disclosure.

FIG. 6 schematically shows an embodiment of a scheme for personalizing audible or visual indicators in a hearing aid according to the present disclosure. FIG. 6 shows an example of an overall solution with some use cases, where the key operations are denoted with square brackets, e.g. [Get indicators] indicating that the hearing aid user (U) or the hearing care professional (HCP) downloads a 'dictionary' of audio and/or visual indicators (e.g. stored on a server, e.g. in the 'Cloud' (denoted 'Cloud Data Storage' in FIG. 6, or locally) to his or her computer or device (AD)).

3. An Example, Adaptive Personalization of Hearing Aid Parameters Using Context Information.

Hearing aid fitting may e.g. be personalized by defining general preferences for low, medium or high attenuation of ambient sounds thus determining auditory focus and noise reduction based on questionnaire input and/or listening tests (e.g. the triple digit test or an STM test, etc.) but these settings do not adapt to the user's cognitive capabilities throughout the day; e.g. the ability to separate voices when in a meeting might be better in the morning or the need for reducing background noise in a challenging acoustical environment could increase in the evening. These threshold values are rarely personalized due to the lack of clinical resources in hearing healthcare, although patients are known to exhibit differences of up to 15 dB (e.g. over the course of a specific time period, e.g. a day) in ability to understand speech in noise. Additionally, hearing aids are calibrated based on pure tone hearing threshold audiograms, which do not capture the large differences in loudness functions (e.g. loudness growth functions) among users. Rationales (VAC+, NAL) converting audiograms to frequency specific amplification are based on average loudness functions (or loudness growth functions), while patients in reality vary by up to 30 dB in in how they binaurally perceive loudness of sounds. Combining internet connected hearing aids with a smartphone app make it feasible to dynamically adapt the thresholds for beamforming or modify gain according to each user's loudness perception.

Even though it is possible to define "if this then that" (IFTTT) rules for changing programs on hearing aids connected via Bluetooth to a smartphone, in such configuration there is no feedback loop for assessing whether the user is satisfied with the hearing aid settings in a given context. Nor does the hearing aid learn from the data in order to automatically adapt the settings to the changing context.

Furthermore, audiological individualization has so far been based on predictive methods, as e.g. currently a questionnaire or a listening test. While this can be a good starting point, it might be expected that a more precise estimation of the individuals' abilities can be achieved via a profiling of individual preferences in various sound environments. Further, an estimation of the individuals Speech Reception Threshold (SRT), or of a full psychometric function, might be possible though a client preference profiling conducted in her/his "real" sound environments.

Based on the above, a better individualized hearing instrument adjustment, using information additional to the audiogram may become possible.

Hearing aids, which are able to store alternative fitting profiles as programs, or other assemblies of settings, make it possible to adapt the auditory focus and noise reduction settings dependent on the context and time of the day. Defining the context based on sound environment (detected by the hearing aid including e.g. SNR and level), smartphone location and calendar data (IFTTT triggers: iOS location, Google calendar event, etc.) allows for modeling user behavior as time series parameters i.e. 'trigger A', 'location B', 'event C', 'time D', "Sound environment type F" which are associated with the preferred hearing aid action 'setting low/medium/high' as exemplified by:

['exited', 'Mikkelborg', 'bike', 'morning', 'high', 'SNR value (dB)']

['entered', 'Eriksholm', 'office', 'morning', 'low, 'SNR value (dB)"]

['calendar', 'Eriksholm', 'lunch', 'afternoon', 'medium', 'SNR value (dB)'] . . . .

In addition to low level signal parameters like SPL or SNR, we classify the soundscape based on audio spectrograms generated by the hearing aid signal processing. This enables not only identifying an environment e.g. 'office', but also differentiating between intents like e.g. 'conversation' (2-3 persons, own voice) versus 'ignore speech' (2-3 persons, own voice not detected). The APP may be configured to 1) automatically adjust the low/medium/high thresholds (SPL, SNR) defining when the beamforming and attenuation should kick in, and 2) dynamically personalize the underlying rationales (VAC+, NAL), by adapting the frequency specific amplification dependent on the predicted environment and intents.

The APP may combine the soundscape 'environment+intent' classification with the user selected preferences, to predict when to modify the rationale by generating an offset in amplification, e.g. +/−6 dB, which is added to or subtracted from the average rationale across e.g. 10 frequency bands from 200 Hz to 8 kHz, as exemplified by:

['office', 'conversation', −2 dB, −1 dB, 0 dB, +2 dB, +2 dB, +2 dB, +2 dB, +2 dB, +2 dB, +2 dB']

['cafe', 'socializing', +2 dB, +2 dB, +1 dB, 0 dB, 0 dB, 0 dB, −1 dB, −2 dB, −2 dB, −2 dB]

That is, the APP may, in dependence on the 'environment+intent' classification, personalize rationales (VAC+, NAL) by overwriting and thereby 1) shaping the gain according to e.g. 'office+conversation' enhance high frequency gain to facilitate speech intelligibility, or 2) modify the gain to individually learned loudness functions based on e.g. 'cafe+socializing' preferences for reducing the perceived loudness of a given environment.

Modeling user behavior as time series parameters ('trigger A', 'location B', 'event C', 'time D', 'setting low/medium/high') provides a foundation for training a decision tree algorithm to predict the optimal setting when encountering a new location or event type.

Applying machine learning techniques to the context data by using the parameters as input for training a classifier would enable prediction of the corresponding change of hearing aid program or change of other assemblies of settings (IFTTT action). Subsequently implementing the trained classifier as an "if this then that" algorithm in a smartphone APP (decision tree), would facilitate prediction and automatic selection of the optimal program whenever the context changes. That is, even when encountering a new location or event, the algorithm will predict the most likely setting based on previously learned behavioral patterns. As an end result, this may improve the individuals' general preference of the Hearing instrument, and/or improve the individual's objective benefit of using the hearing instruments, as e.g. speech intelligibility (SI).

The APP should additionally provide a simple feedback interface (accept/decline) enabling the user to indicate if the setting is not satisfactory to assure that the parameters are continuously updated and that the classifier is retrained. Even with little training data the APP would thus be able to adapt the hearing aid settings to the user's cognitive capabilities and changing sound environments throughout the day. Likewise, the generated data and user feedback might provide valuable insights, such as which hearing aids settings are selected in which context. Such information may be useful in order to further optimize the embedded signal processing capabilities within the hearing aids.

FIG. 7 schematically illustrates an embodiment of a method of generating a database for training an algorithm (e.g. a neural network) for adaptively providing personalized parameter settings of a processing algorithm of a hearing aid. The method may e.g. comprise the following steps S1. Mount an operational hearing aid on a user.

S2. Connect the hearing aid to an APP of an auxiliary device, e.g. a smartphone or similar processing device.

S3. Pick up and analyze sound signals of a current acoustic environment of the user (by hearing aid and/or auxiliary device).

S4. Extract relevant parameters of the acoustic environment (average sound level, noise level, SNR, music, single talker, multi-talker, conversation, speech, no speech, estimated speech intelligibility, etc.)

S5. Possibly extract parameters of the physical environment (e.g. time of day; location, temperature, wind speed).

S6. Possibly extract parameters of the user's state (e.g. cognitive load; movement pattern; temperature, etc.).

S7. Automatically store corresponding values of said parameters (related to the acoustic environment, the physical environment, the user's state) together with settings of the hearing aid, which can be changed by the user (e.g. volume, program, etc.).

The database may be generated during a learning mode of the hearing aid, where the user encounters a number of relevant acoustic situations (environments) in various states (e.g. at different times of day). In the learning mode, the user may be allowed to influence processing parameters of selected algorithms, e.g. noise reduction (e.g. thresholds for attenuating noise) or directionality (e.g. thresholds for applying directionality).

An algorithm (e.g. an artificial neural network, e.g. a deep neural network) may e.g. be trained using a database of 'ground truth' data as outline above in an iterative process, e.g. by applying a cost function. The training may e.g. be performed by using numerical optimization methods, such as e.g. (iterative) stochastic gradient descent (or ascent), or Adaptive Moment Estimation (Adam). A thus trained algorithm may be applied to the processor of the hearing aid during its normal use. Alternatively or additionally, a trained (possibly continuously updated) algorithm may be available during normal use of the hearing aid, e.g. via a smartphone, e.g. located in the cloud. A possible delay introduced by performing some of the processing in another device (or on a server via a network, e.g. 'the cloud') may be acceptable, because is not necessary to apply modifications (personalization) of processing of the hearing aid within milli-seconds or seconds.

During normal use, the data that are referred to in steps S3-S6 may be generated and fed to a trained algorithm whose output may be (estimated) volume and/or program settings and/or personalized parameters of a processing algorithm for the given environment and mental state of the user.

Figure 8A:
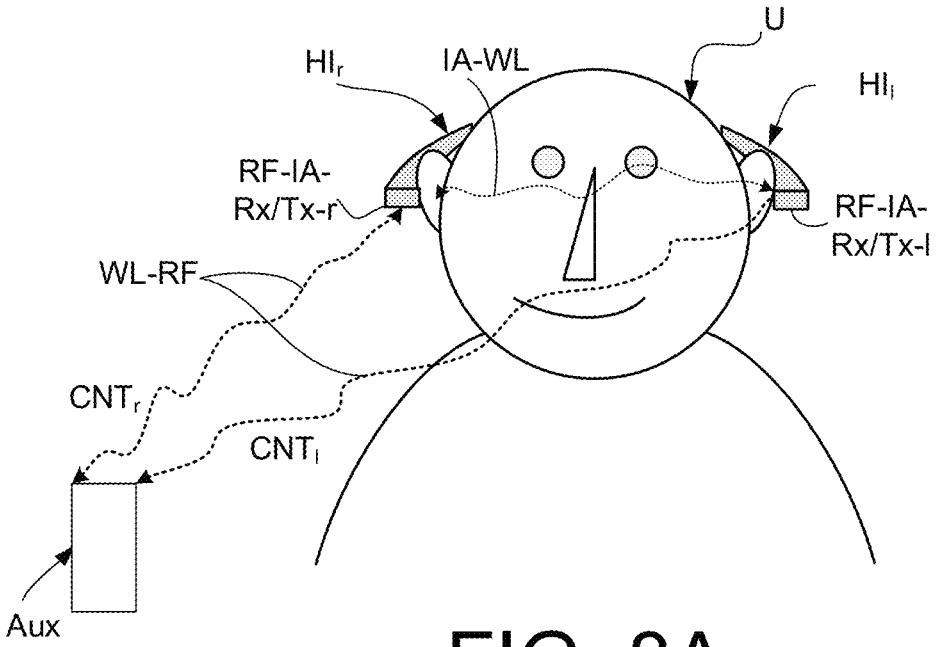
FIG. 8A shows a hearing binaural hearing aid system comprising a pair of hearing aids in communication with each other and with an auxiliary device implementing a user interface.
Figure 8B:
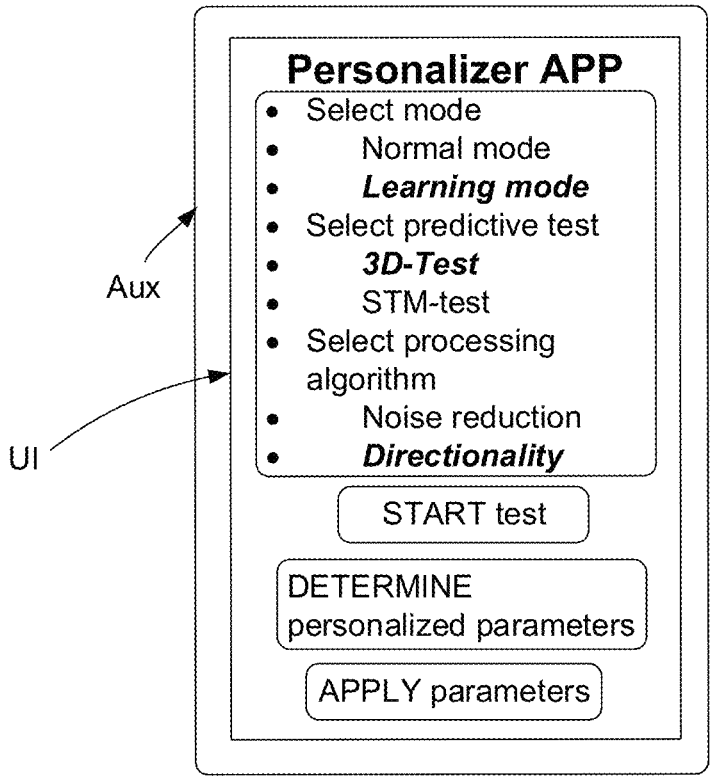
FIG. 8B shows the user interface implemented in the auxiliary device of the binaural hearing aid system of FIG. 8A, and FIG. 8C schematically shows a hearing aid of the receiver in the ear type according to an embodiment of the present disclosure, as e.g. used in the binaural hearing aid system of FIG. 8A.

FIG. 8A illustrates an embodiment of a hearing system, e.g. a binaural hearing aid system, according to the present disclosure. The hearing system comprises left and right hearing aids in communication with an auxiliary device, e.g. a remote control device, e.g. a communication device, such as a cellular telephone or similar device capable of establishing a communication link to one or both of the left and right hearing aids. FIG. 8B illustrates an auxiliary device configured to execute an application program (APP) implementing a user interface of the hearing system from which functionality of the hearing system, e.g. a mode of operation, can be selected.

FIG. 8A, 8B together illustrate an application scenario comprising an embodiment of a binaural hearing aid system comprising first (left) and second (right) hearing aids (HD1, HD2) and an auxiliary device (AD) according to the present disclosure. The auxiliary device (AD) comprises a cellular telephone, e.g. a Smartphone. In the embodiment of FIG. 8A, the hearing aids and the auxiliary device are configured to establish wireless links (WL-RF) between them, e.g. in the form of digital transmission links according to the Bluetooth standard (e.g. Bluetooth Low Energy, or equivalent technology). The links may alternatively be implemented in any other convenient wireless and/or wired manner, and according to any appropriate modulation type or transmission standard, possibly different for different audio sources. The auxiliary device (e.g. a Smartphone) of FIG. 8A, 8B comprises a user interface (UI) providing the function of a remote control of the hearing aid or system, e.g. for changing program or mode of operation or operating parameters (e.g. volume) in the hearing aid(s), etc. The user interface (UI) of FIG. 8B illustrates an APP (denoted 'Personalizer APP' for selecting a mode of operation of the hearing system (between a 'Normal mode' and a 'Learning mode'. In the 'Learning mode' (assumed to be selected in the example of FIG. 8B, as indicated by the bold, italic font), a personalization of processing parameters can be performed by the user, as described in the present disclosure. A choice between a number of predictive tests can be performed via the 'Personalizer APP' (here between the 'triple digit test' (3D-Test) and the 'Spectro-temporal modulation' (STM-test)). In the example of FIG. 8B, the 3D-Test has been selected. A further choice to select a processing algorithm to be personalized can be made via the user interface (UI). In the example of FIG. 8B, a choice between a 'Noise reduction' algorithm and a 'Directionality' algorithm can be made; the Directionality algorithm has been selected. The screen further comprises the instruction initiations 'buttons'

'START test' for initiating the selected predictive test (here the 'triple digit test', cf. e.g. FIG. 5), 'DETERMINE personalized parameters' for initiating calculation of personalized parameters of the selected processing algorithm (here directionality) in dependence of a hearing ability measure extracted from the selected predictive test (here the 'triple digit test') and a cost-benefit function (or subcomponent thereof) for the selected processing algorithm and user. And 'APPLY parameters' for storing the determined personalized parameters for the selected processing algorithm for future use in the hearing aid of the user in question.

The APP may comprise further screens or functions, e.g. allowing a user to evaluate the determined personalized parameters before accepting them (via the APPLY parameters 'button'), e.g. as outlined in FIG. 4 and the corresponding description.

Figure 8C:
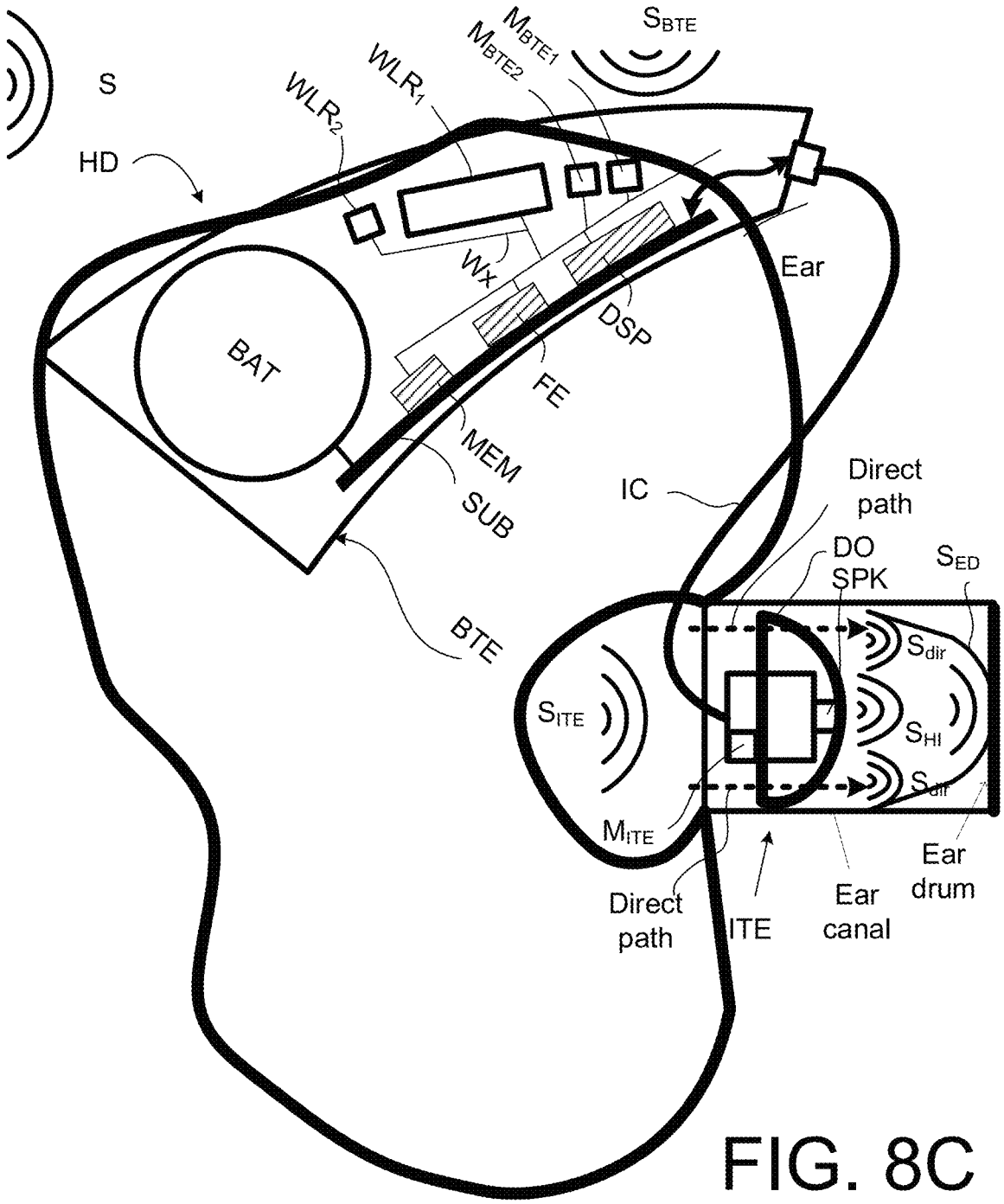

The hearing aids (HD1, HD2) are shown in FIG. 8A as devices mounted at the ear (behind the ear) of a user (U), cf. e.g. FIG. 8C. Other styles may be used, e.g. located completely in the ear (e.g. in the ear canal), fully or partly implanted in the head, etc. As indicated in FIG. 8A, each of the hearing instruments may comprise a wireless transceiver to establish an interaural wireless link (IA-WL) between the hearing aids, e.g. based on inductive communication or RF communication (e.g. Bluetooth technology). Each of the hearing aids further comprises a transceiver for establishing a wireless link (WL-RF, e.g. based on radiated fields (RF)) to the auxiliary device (AD), at least for receiving and/or transmitting signals, e.g. control signals, e.g. information signals, e.g. including audio signals. The transceivers are indicated by RF-IA-Rx/Tx-1 and RF-IA-Rx/Tx-2 in the right (HD2) and left (HD1) hearing aids, respectively.

In an embodiment, the remote control APP is configured to interact with a single hearing aid (instead of with a binaural hearing aid system).

In the embodiment of FIG. 8A, 8B, the auxiliary device is described as a smartphone. The auxiliary device may, however, be embodied in other portable electronic devices, e.g. an FM-transmitter, a dedicated remote control device, a smartwatch, a tablet computer, etc.

FIG. 8C shows a hearing aid of the receiver in the ear type (a so-called BTE/RITE style hearing aid) according to an embodiment of the present disclosure (BTE='Behind-The-Ear'; RITE=Receiver-In-The-Ear'). The exemplary hearing aid (HD) of FIG. 8C, e.g. an air conduction type hearing aid, comprises a BTE-part (BTE) adapted for being located at or behind an ear of a user, and an ITE-part (ITE) adapted for being located in or at an ear canal of the user's ear and comprising a receiver (=loudspeaker, SPK). The BTE-part and the ITE-part are connected (e.g. electrically connected) by a connecting element (IC) and internal wiring in the ITE- and BTE-parts (cf. e.g. wiring Wx in the BTE-part). The connecting element may alternatively be fully or partially constituted by a wireless link between the BTE- and ITE-parts. Other styles, e.g. where the ITE-part comprises or is constituted by a custom mould adapted to a user's ear and/or ear canal, may of course be used.

In the embodiment of a hearing aid in FIG. 8C, the BTE part comprises an input unit comprising two input transducers (e.g. microphones) ($M_{BTE1}$, $M_{BTE2}$), each for providing an electric input audio signal representative of an input sound signal ($S_{BTE}$) (originating from a sound field S around the hearing aid). The input unit further comprises two wireless receivers ($WLR_1$, $WLR_2$) (or transceivers) for providing respective directly received auxiliary audio and/or control input signals (and/or allowing transmission of audio and/or control signals to other devices, e.g. a remote control or processing device, or a telephone, or another hearing aid). Access to a processing power in an auxiliary device and/or on a server connected to a network (e.g. 'the cloud') may be provided via one of the wireless transceivers ($WLR_1$, $WLR_2$). The hearing aid (HD) comprises a substrate (SUB) whereon a number of electronic components are mounted, including a memory (MEM), e.g. storing different hearing aid programs (e.g. user specific data, e.g. related to an audiogram, or (e.g. including personalized) parameter settings derived therefrom or provided via the Personalizer APP (cf. FIG. 2), e.g. defining such (user specific) programs, or other parameters of algorithms, e.g. beamformer filter weights, and/or fading parameters) and/or hearing aid configurations, e.g. input source combinations ($M_{BTE1}$, $M_{BTE2}$ ($M_{ITE}$), $WLR_1$, $WLR_2$), e.g. optimized for a number of different listening situations. The memory (MEM) may further comprise a database of personalized parameter settings for different acoustic environments (and/or different processing algorithms) according to the present disclosure. In a specific mode of operation, two or more of the electric input signals from the microphones are combined to provide a beamformed signal provided by applying appropriate (e.g. complex) weights to (at least some of) the respective signals. The beamformer weights are preferably personalized as proposed in the present disclosure.

The substrate (SUB) further comprises a configurable signal processor (DSP, e.g. a digital signal processor), e.g. including a processor for applying a frequency and level dependent gain, e.g. providing beamforming, noise reduction, filter bank functionality, and other digital functionality of a hearing aid, e.g. implementing features according to the present disclosure. The configurable signal processor (DSP) is adapted to access the memory (MEM) e.g. for selecting appropriate parameters for a current configuration or mode of operation and/or listening situation and/or for writing data to the memory (e.g. algorithm parameters, e.g. for logging user behavior) and/or for accessing the database of personalized parameters according to the present disclosure. The configurable signal processor (DSP) is further configured to process one or more of the electric input audio signals and/or one or more of the directly received auxiliary audio input signals, based on a currently selected (activated) hearing aid program/parameter setting (e.g. either automatically selected, e.g. based on one or more sensors, or selected based on inputs from a user interface). The mentioned functional units (as well as other components) may be partitioned in circuits and components according to the application in question (e.g. with a view to size, power consumption, analogue vs. digital processing, acceptable latency, etc.), e.g. integrated in one or more integrated circuits, or as a combination of one or more integrated circuits and one or more separate electronic components (e.g. inductor, capacitor, etc.). The configurable signal processor (DSP) provides a processed audio signal, which is intended to be presented to a user. The substrate further comprises a front-end IC (FE) for interfacing the configurable signal processor (DSP) to the input and output transducers, etc., and typically comprising interfaces between analogue and digital signals (e.g. interfaces to microphones and/or loudspeaker(s), and possibly to sensors/detectors). The input and output transducers may be individual separate components, or integrated (e.g. MEMS-based) with other electronic circuitry.

The hearing aid (HD) further comprises an output unit (e.g. an output transducer) providing stimuli perceivable by the user as sound based on a processed audio signal from the processor or a signal derived therefrom. In the embodiment of a hearing aid in FIG. 8C, the ITE part comprises (at least a part of) the output unit in the form of a loudspeaker (also termed a 'receiver') (SPK) for converting an electric signal to an acoustic (air borne) signal, which (when the hearing aid is mounted at an ear of the user) is directed towards the ear drum (Ear drum), where sound signal ($S_{ED}$) is provided. The ITE-part further comprises a guiding element, e.g. a dome, (DO) for guiding and positioning the ITE-part in the ear canal (Ear canal) of the user. In the embodiment of FIG. 8C, the ITE-part further comprises a further input transducer, e.g. a microphone ($M_{ITE}$), for providing an electric input audio signal representative of an input sound signal ($S_{ITE}$) at the ear canal. Propagation of sound ($S_{ITE}$) from the environment to a residual volume at the ear drum via direct acoustic paths through the semi-open dome (DO) are indicated in FIG. 8C by dashed arrows (denoted Direct path). The directly propagated sound (indicated by sound fields $S_{dir}$) is mixed with sound from the hearing aid (HD) (indicated by sound field $S_{HI}$) to a resulting sound field ($S_{ED}$) at the ear drum. The ITE-part may comprise a (possibly custom made) mould for providing a relatively tight fitting to the user's ear canal (thereby minimizing the directly propagated sound towards the ear-drum and the leakage of sound from the loudspeaker to the environment. The mould may comprise a ventilation channel to provide a (controlled) leakage of sound from the residual volume between the mould and the ear drum (to manage the occlusion effect).

The electric input signals (from input transducers $M_{BTE1}$, $M_{BTE2}$, $M_{ITE}$) may be processed in the time domain or in the (time-) frequency domain (or partly in the time domain and partly in the frequency domain as considered advantageous for the application in question).

All three ($M_{BTE1}$, $M_{BTE2}$, $M_{ITE}$) or two of the three microphones ($M_{BTE1}$, $M_{ITE}$) may be included in the 'personalization'-procedure according to the present disclosure. The 'front'-BTE-microphone ($M_{BTE1}$) may be selected as a reference microphone.

In the embodiment of FIG. 8C, the connecting element (IC) comprises electric conductors for connecting electric components of the BTE and ITE-parts. The connecting element (IC) may comprise an electric connector (CON) to attach the cable (IC) to a matching connector in the BTE-part. In another embodiment, the connecting element (IC) is an acoustic tube and the loudspeaker (SPK) is located in the BTE-part. In a still further embodiment, the hearing aid comprises no BTE-part, but the whole hearing aid is housed in the ear mould (ITE-part).

The embodiment of a hearing aid (HD) exemplified in FIG. 8C is a portable device comprising a battery (BAT), e.g. a rechargeable battery, e.g. based on Li-Ion battery technology, e.g. for energizing electronic components of the BTE- and possibly ITE-parts. In an embodiment, the hearing aid is adapted to provide a frequency dependent gain and/or a level dependent compression and/or a transposition (with or without frequency compression of one or more frequency ranges to one or more other frequency ranges), e.g. to compensate for a hearing impairment of a user. The BTE-part may e.g. comprise a connector (e.g. a DAI or USB connector) for connecting a 'shoe' with added functionality (e.g. an FM-shoe or an extra battery, etc.), or a programming device (e.g. a fitting system), or a charger, etc., to the hearing aid (HD). Alternatively or additionally, the hearing aid may comprise a wireless interface for programming and/or charging the hearing aid.

In the present disclosure a scheme for personalizing settings has been described in the framework of processing algorithms (e.g. directional or noise reduction algorithms) using predictive tests. One could, however, also use these types of tests for the prescription of physical acoustics, including for example a ventilation channel ('vent').

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method are not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein but are to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

Bernstein, J. G. W., Mehraei, G., Shamma, S., Gallun, F. J., Theodoroff, S. M., and Leek, M. R. (2013). "Spectrotemporal modulation sensitivity as a predictor of speech intelligibility for hearing-impaired listeners," J. Am. Acad. Audiol., 24, 293-306. doi:10.3766/jaaa.24.4.5.

[ANSI/ASA S3.5; 1997] "American National Standard Methods for the Calculation of the Speech Intelligibility Index," ANSI/ASA S3.5, 1997 Edition, Jun. 6, 1997.

[Taal et al.; 2010] Cees H. Taal; Richard C. Hendriks; Richard Heusdens; Jesper Jensen, "A short-time objective intelligibility measure for time-frequency weighted noisy speech", ICASSP 2010 IEEE International Conference on Acoustics, Speech and Signal Processing, pp. 4214-4217.

[Moore et al.; 2000] Moore, B. C. J., Huss, M., Vickers, D. A., Glasberg, B. R., and Alcantara, J. I. (2000). "A test for the diagnosis of dead regions in the cochlea," Br. J. Audiol., doi: 10.3109/03005364000000131. doi:10.3109/03005364000000131.

[Elberling et al.; 1989] C. Elberling, C. Ludvigsen and P. E. Lyregaard, "DANTALE: A NEW DANISH SPEECH MATERIAL", Scand. Audiol. 18, pp. 169-175, 1989.

[Bernstein et al.; 2016] Bernstein, J. G. W., Danielsson, H., Hallgren, M., Stenfelt, S., Ronnberg, J., & Lunner, T., "Spectrotemporal Modulation Sensitivity as a Predictor of Speech-Reception Performance in Noise With Hearing Aids", Trends in Hearing, vol. 20, pp. 1-17, 2016.

The invention claimed is:

1. A method of personalizing one or more parameters of a processing algorithm for use in a processor of a hearing aid for a specific user, the method comprising performing a predictive test for estimating a hearing ability of the user when listening to test signals having different characteristics;

analyzing results of said predictive test for said user and providing a hearing ability measure for said user;

selecting a specific processing algorithm comprising a directionality algorithm of said hearing aid;

selecting a cost-benefit function for said specific processing algorithm related to said user's hearing ability in dependence of said characteristics of said test signals, wherein said cost-benefit function provides a tradeoff between the benefits of directionality and the costs of directionality, wherein said directionality algorithm tends to provide a benefit to said specific user when a target signal is at a location that is relatively enhanced by beamforming and to incur costs to said specific user when attending to locations that are strongly attenuated by beamforming; and determining, for said user, one or more personalized parameters of said specific processing algorithm in dependence of said hearing ability measure and said cost-benefit function.

2. A method according to claim 1 wherein said hearing ability measure comprises a speech intelligibility measure or a frequency discrimination measure or an amplitude discrimination measure, or a frequency selectivity measure or a temporal selectivity measure.

3. A method according to claim 1 wherein said different characteristics of the test signals are represented by one or more of different signal-to-noise ratios (SNR), different modulation depths or modulation indices, or different detection thresholds of tones in broadband, bandlimited or band-stop noise, describing frequency selectivity, different detection thresholds for temporal gaps in broadband or bandlimited noise, describing temporal selectivity, different depths or indices of amplitude modulation as a function of modulation frequency, different frequency or depth of spectral modulation, sensitivity to frequency modulation at varying center frequencies and bandwidths, and direction of frequency modulation including discrimination of positive from negative phase of Schroeder-phase stimuli.

4. A method according to claim 1 comprising selecting the predictive test for estimating a degree of hearing ability of the user.

5. A method according to claim 1 wherein said predictive test is selected from the group comprising Spectro-temporal modulation test, Triple Digit Test, Gap detection, Notched noise test, TEN test, and Cochlear compression.

6. A method according to claim 1 wherein said processing algorithm further comprises one or more of a noise reduction algorithm, a feedback control algorithm, a speaker separation and a speech enhancement algorithm.

7. A method according to claim 1 forming part of a fitting session wherein the hearing aid is adapted to the needs of the user.

8. A method according to claim 1 wherein the step of performing the predictive test comprises initiating a test mode of an auxiliary device; and executing said predictive test via said auxiliary device.

9. A method according to claim 8 wherein said step of performing the predictive test is initiated by said user.

10. A method according to claim 1, wherein the cost-benefit function is configured to quantify the user's costs and benefits of helping systems.

11. A method according to claim 1, wherein the cost-benefit function relates to the benefit of speech intelligibility, sound quality and listening effort.

12. A method according to claim 1, wherein the cost-benefit function is estimated as the improvement due to directionality for targets from the front minus the decrement due to directionality for off-axis targets.

13. A method according to claim 1, further comprising providing an assessment of where the user's cost-benefit function crosses over from net benefit to net cost.

14. A method according to claim 1, further comprising providing an assessment of at which signal-to-noise ratio the user's cost-benefit function crosses over from net benefit to net cost.

15. A method according to claim 1, wherein said cost-benefit function is expressed as a function of signal to noise ratio (SNR) for a direction algorithm (MVDR) exhibiting off-axis costs and on-axis benefits.

16. A method according to claim 15, wherein said cost-benefit function is estimated as the improvement due to directionality for targets from the front minus the decrement due to directionality for off-axes targets.

17. A method according to claim 1, wherein said cost-benefit function relates to aspects of hearing aid outcome including one or more of speech intelligibility, sound quality, and listening effort.

18. A hearing aid configured to be worn at or in an ear of a user and/or for being at least partially implanted in the head of a user, the hearing aid comprising:

a forward path for processing an electric input signal representing sound provided by an input unit, and for presenting a processed signal perceivable as sound to the user via an output unit, the forward path comprising a processor for performing said processing by executing one or more configurable processing algorithms, wherein parameters of said one or more configurable processing algorithms are personalized to the specific needs of the user by performing a predictive test for estimating a hearing ability of the user when listening to test signals having different characteristics;

analyzing results of said predictive test for said user and providing a hearing ability measure for said user;

selecting a specific processing algorithm comprising a directionality algorithm of said hearing aid;

selecting a cost-benefit function for said specific processing algorithm related to said user's hearing ability in dependence of said characteristics of said test signals, wherein said cost-benefit function provides a tradeoff between the benefits of directionality and the costs of directionality, wherein said directionality algorithm tends to provide a benefit to said specific user when a target signal is at a location that is relatively enhanced by beamforming and to incur costs to said specific user when attending to locations that are strongly attenuated by beamforming; and determining, for said user, one or more personalized parameters of said specific processing algorithm in dependence of said hearing ability measure and said cost-benefit function.

19. A hearing aid according to claim 18 being constituted by or comprising an air-conduction type hearing aid, a bone-conduction type hearing aid, a cochlear implant type hearing aid, or a combination thereof.

20. A hearing system comprising:

a hearing aid according to claim 10; and an auxiliary device, the hearing system being adapted to establish a communication link between the hearing aid and the auxiliary device to provide that data can be exchanged or forwarded from one to the other, wherein the auxiliary device is configured to execute an application implementing a user interface for the hearing aid and allowing a predictive test for estimating a hearing ability of a user to be initiated by the user and executed by the auxiliary device including a) playing sound elements of said predictive test via a loudspeaker of the auxiliary device, or b) transmitting sound elements of said predictive test via said communication link to said hearing device for being presented to the user via an output unit of the hearing aid, and wherein the user interface is configured to receive responses of the user to the predictive test, and wherein the auxiliary device is configured to store said responses of the user to the predictive test.

21. A hearing system according to claim 20 wherein the auxiliary device comprises a remote control, a smartphone, or other portable or wearable electronic device.

22. A hearing system according to claim 20 wherein the auxiliary device comprises or forms part of a fitting system for adapting the hearing aid to a particular user's needs.

23. A hearing system according to claim 20 wherein the auxiliary device is configured to estimate a speech reception threshold of the user from the responses of the user to the predictive test.

24. A hearing system according to claim 20 wherein the auxiliary device is configured to execute the predictive test as a triple digit test where sound elements of said predictive test comprise digits a) played at different signal to noise ratios, or b) digits played at a fixed signal to noise ratio, but with different hearing aid parameters.

25. A non-transitory application, termed an APP, comprising executable instructions configured to be executed on an auxiliary device to implement a user interface for a hearing system comprising a hearing aid, wherein the APP is configured to allow a user to perform the following steps select and initiate a predictive test for estimating a hearing ability of the user when listening to test signals having different characteristics;

initiate an analysis of results of said predictive test for said user and providing a hearing ability measure for said user;

select a specific processing algorithm comprising a directionality algorithm of said hearing aid, select a cost-benefit function for said algorithm related to said user's hearing ability in dependence of said different characteristics of said test signals, wherein said cost-benefit function provides a tradeoff between the benefits of directionality and the costs of directionality, wherein said directionality algorithm tends to provide a benefit to said specific user when a target signal is at a location that is relatively enhanced by beamforming and to incur costs to said specific user when attending to locations that are strongly attenuated by beamforming; and determine, for said user, one or more personalized parameters of said processing algorithm in dependence of said hearing ability measure and said cost-benefit function.

26. A non-transitory application according to claim 25, configured to allow the user to apply said personalized parameters to said processing algorithm.

27. A non-transitory application according to claim 26, configured to allow the user to check the result of said personalized parameters when applied to an input sound signal provided by an input unit of the hearing aid and when the resulting signal is played for the user via an output unit of the hearing aid; and accept or reject the personalized parameters.

* * * * *